US006314646B1

(12) United States Patent
Schmidt

(10) Patent No.: US 6,314,646 B1
(45) Date of Patent: Nov. 13, 2001

(54) UTILITY KNIFE

(75) Inventor: G. Gerry Schmidt, Newport Beach, CA (US)

(73) Assignee: Pacific Handy Cutter, Inc., Costa Mesa, CA (US)

( * ) Notice: Subject to any disclaimer, the term of this patent is extended or adjusted under 35 U.S.C. 154(b) by 0 days.

(21) Appl. No.: 09/461,937

(22) Filed: Dec. 15, 1999

(51) Int. Cl.[7] ..... B26B 1/08
(52) U.S. Cl. ..... 30/162; 30/2; 30/125
(58) Field of Search ..... 30/2, 125, 162, 30/320, 331, 335, 339

(56) References Cited

U.S. PATENT DOCUMENTS

| | | | |
|---|---|---|---|
| D. 319,378 | 8/1991 | Wilcox . | |
| 3,577,637 | 5/1971 | Braginetz | 30/162 |
| 3,857,176 | 12/1974 | Quenot | 30/162 |
| 3,879,847 | 4/1975 | Roll | 30/162 |
| 3,906,627 | 9/1975 | Manning | 30/162 |
| 3,927,473 | 12/1975 | Braginetz | 30/125 |
| 4,005,525 | 2/1977 | Gringer | 30/125 |
| 4,744,146 | 5/1988 | Schmidt | 30/162 |
| 4,939,839 | 7/1990 | Gorst | 30/125 |
| 5,022,156 | 6/1991 | Kallens et al. | 30/125 |
| 5,054,198 | 10/1991 | Gmoch | 30/2 |
| 5,613,300 | 3/1997 | Schmidt | 30/2 |

*Primary Examiner*—Hwei-Slu Payer

(57) ABSTRACT

A utility knife in accordance with the present invention includes a handle having a longitudinal cavity, a channel member fixedly received in the longitudinal cavity, a blade carrier slidably received in the channel member and configured to receive a cutting blade, an operating button to facilitate movement of the blade carrier to a selected operating position, and a catch to prevent the blade carrier from being extended forward of a selected position with respect to the channel member.

19 Claims, 6 Drawing Sheets

UTILITY KNIFE

BACKGROUND OF THE INVENTION

1. Field of the Invention

The present invention relates generally to a utility knife and methods of making such a knife. More particularly, the present invention relates to an improved utility knife with features to improve functionality and safety.

2. Description of the Related Art

Those concerned with the art are desirous of making a utility knife which is inexpensive, safe, versatile, and rugged. Further, it is desirable to provide a utility knife which reduces or prevents damage to the contents of cardboard boxes opened with the knife, and which is durable and easy to use. Optimally a utility knife is easily grasped and provides a secure grip, safety and certainty in its use, even while the user's hands are moist and slippery. It is desirable that a utility knife reduce the fatigue inherent in strenuous and hard cutting in which such knives are used. Further, practitioners in the art desire to provide a knife that can be manufactured at reasonable cost and which will provide convenience in the use and maintenance, which is aesthetically pleasing and comfortable to hold, and which is as safe as possible, given the inherently dangerous nature of the device and its customary uses. It is also desirable to provide for safe and convenient storage of spare knife blades within the utility knife itself.

For example, U.S. Pat. No. 3,192,624, issued to D. Gringer, teaches a utility knife in which a handle has a forward longitudinal cavity in which a blade carrier member is slidably received. The disclosed knife has a rear cavity in which a number of spare blades are received. The blade carrier member carries a double-ended cutting blade, and is movable longitudinally within the forward cavity between a retracted safety position wherein the blade is entirely within the handle, and an extended operating position where a triangular end part of the blade extends forwardly out of the handle. The handle is vertically split and includes two portions which are almost mirror images of one another. A screw secures the two handle portions together, and allows their separation with the use of a screwdriver. This separation allows reversal of the cutting blade and substitution of one of the unused spare blades for a used cutting blade.

A similar utility knife is presented in U.S. Pat. No. 3,879,847, issued to D. Roll, in which blades may be changed without disassembly of the handle by forward extension therefrom of a forward part of a channel-like blade carrier member. As the Roll disclosure points out, his utility knife avoids the inconvenience of carrying a screwdriver with which to open the handle of prior utility knives. However, his knife does not offer the convenience of spare blade storage in the knife handle.

Another type of utility knife is represented by German Patent No. 531,248, and descendants of the disclosed design. This type of utility knife includes a flattened tubular handle, with a blade carrier slidable in the handle between a retracted position, sheathing the blade entirely in the handle, and an extended operating position, in which part of the blade is exposed forwardly of the handle. A spring-arm part of the blade carrier includes a lug receivable in spaced-apart notches incorporated in the handle to retain the carrier in selected positions, including a retracted position and various positions of blade extension. A button is secured to the spring arm for disengaging the lug from the notches and moving the blade carrier to a selected position.

Variations within this design type include differing handle designs, differing means of securing the blade carrier in position, and the use of differing types of blades. For example, a common single-edge razor blade is a favored blade for many of these prior utility knives, although it has many deficiencies in such use. Such a razor blade is brittle, thin, and not very rugged. Consequently, a razor blade may break off if a large or repetitive twisting or bending force is imposed on the blade in use. Certain other of these knives use a trapezoidal-shaped double ended all-purpose (AP) blade, which is considerably more rugged than a razor blade.

U.S. Pat. Nos. 2,840,903, 3,195,231, 3,525,152, 3,621,570 and 4,570,342 may be considered as representative design descendants of German Patent No. 531,248 discussed above. Generally, this type of knife is made with a handle of folded sheet metal. The handle has a rather small edge radius due to this construction. These knives are relatively thin, and provide only a small handle edge surface area against which manual cutting pressure may be exerted. This small handle edge radius and small edge surface area can combine to make many of these knives quite uncomfortable to use, especially in hard cutting. Even when the user is wearing gloves, some of these knives are so thin that an uncomfortable pressure groove is often formed in the user's hand during hard cutting work. Users may then find themselves shifting the knife in their hand to avoid the sensitive pressure groove, and in the process may be found attempting to use the knife in a less than optimum grip position. Understandably, this kind of incorrect use may contribute to fatigue and injuries. Especially in hard use, the thin, fragile, or difficult to control knives of the above-described category are generally recognized as having limitations in applications to which they can be put.

A further variation of utility knife design is represented by knives specially adapted for opening cardboard cartons or boxes. In this use, the carton is generally held in front of the user with one hand and arm, and is cut by drawing the knife with the other hand toward the user across the side wall of the carton. Because such use in a commercial setting frequently involves the need for speedy work, and cardboard does present considerable resistance to cutting, flesh wounds are common. For example, sometimes, as a result of insufficient care by a user, the knife blade springs free at the end of a cut and catches the user's arm. In the design of knives for this use, particular attention must be given to protecting both a user of the knife, and the contents of a cardboard carton to be opened, from inadvertent cuts.

U.S. Pat. No. 3,178,812, issued to A. J. Lurie, discloses a utility knife having a pair of spaced-apart plate-like blade guards. One guard is for inside, and the other for outside, of a carton. The inner guard is to protect the carton contents during cutting of the carton sidewall, and is carried at the end of a hook-like extension of the handle. This type of utility knife presents at least some inconvenience in use because of the necessity to provide for entry into the carton of the inner plate-like guard.

A similar hook-like guard is disclosed in U.S. Pat. No. 4,167,810, issued to R. Gilbert. The Gilbert reference also discloses protecting the contents of a carton from the blade while the carton is opened. A hard point is provided for punching a hole in the carton for subsequent insertion of the hook-like guard.

An alternative form of blade guard, in this case for protecting the user, is seen in U.S. Pat. No. 4,675,996, issued in 1987 to T. DuBuque. The Dubuque disclosure teaches a pair of spring-loaded pivotal guard plates secured to the handle of the knife to prevent accidental exposure of the blade edge. The guards taught are stated to pivot and expose the blade edge when the knife is drawn along the side of a carton. Why these pivotal guard plates would not also pivot away to expose the blade if the knife were inadvertently drawn across the user's arm, for example, is not clear from the patent. Some mitigation of the danger of inadvertent cutting of the user is contemplated by the disclosure however.

A further alternative form of blade guard, for protecting both user and carton contents, is disclosed in U.S. Pat. No. 4,744,146, issued to the present inventor named herein. In my knife design disclosed in that reference, a plate-like guard member lies parallel and adjacent to, but spaced apart from, the blade in its extended position. The plate-like guard member provides a guide surface by which the knife may be guided along the top corner of a carton to be opened while the carton side wall is cut to remove the carton top. Because the edge of the blade is recessed behind the edges of the guard plate, a user of the knife is less likely to be cut with the knife. Also, the blade penetrates the side wall of the carton to a controlled distance in a location immediately adjacent to a top inside surface of the carton. Consequently, the contents are less likely to be damaged by the blade. The knife design disclosed also offers improved purchase and ease of use. This is because the handle is formed of a sturdy aluminum extrusion offering a considerably larger surface area against which cutting pressure can be applied by a user of the knife, as well as comfortable rounded outer edge surfaces of relatively large radius. This prior knife design also includes features which help avoid accidental dropping of the worn blade when blade replacement is necessary, and provides for storage of several spare blades within the knife handle.

A similar guard member is seen in U.S. Pat. No. 5,054,198, issued to R. Gmoch. The disclosure of that reference differs from my prior design in several ways, but so far as the guard feature is concerned, it differs with regard to an angular relationship between the guard and the cutting blade.

SUMMARY OF THE INVENTION

It has been recognized that there is a need for further improvements directed to safety and comfort for the user of utility knives. A utility knife in accordance with the present invention addresses this need, and includes an ergonomically-shaped handle having a longitudinal cavity, a channel member fixedly received in the longitudinal cavity, a blade carrier slidably received in the channel member, the blade carrier adapted to receive a cutting blade, an operating button connected to the blade carrier to facilitate movement of the blade carrier to a plurality of operating positions, and a releasable catch to prevent the blade carrier from being inadvertently fully extended.

In a more detailed aspect, the channel member has an upper channel portion and a lower channel portion. Defining the blade end of the knife as the front end and the opposite end as the back end, and right and left sides as would be perceived by a viewer looking at the front end in elevation view, and using corresponding directions for reference, at a back end the lower channel portion includes a retainer tang. When the channel member is inserted into the longitudinal cavity of the handle, the lower channel portion lays on top of a raised platform defined by the handle within the cavity, such that the retainer tang extends beyond the platform. The retainer tang can then be bent generally downward to form a hook, to permanently retain the channel member inside the handle.

In a further more detailed aspect, the channel member is adapted to slidably receive a blade carrier. The blade carrier has a web portion, with an upper laterally extending wall, and a lower laterally extending wall. The web portion, the upper laterally extending wall, and the lower laterally extending wall together define a blade receiving recess configured to receive and hold a blade. The web portion has a raised alignment tab to guide the placement of the cutting blade. To properly replace the blade, a user aligns a cut-out section of the blade with the raised alignment tab. After the blade is properly placed on the blade carrier, the raised alignment tab assists in holding the blade in place.

In another detailed aspect, the catch mentioned above is formed from the cooperation of a number of elements, including a restraining spring element depending from the lower laterally extending wall of the blade carrier, an open recess formed in the lower channel portion of the channel member, and a safety lever formed on the lower concave surface of the handle. The restraining spring is formed such that it has a downward bias when received in the channel member. The recess in the lower channel portion of the channel member is configured to receive the restraining spring. When blade carrier is moved to a last cutting position, the restraining spring aligns with the recess. The downward bias of the restraining spring causes the spring to drop down into the recess and catch on the lower channel portion of the channel member at the recess. The contact between the restraining spring and the lower channel portion restricts forward longitudinal movement of the blade carrier.

The safety lever allows the user to override the catch and move the blade carrier from the last cutting position to a blade change position. To actuate the safety lever, the user needs to apply pressure to the safety lever to cause it to move inward and cause the restraining spring to move inward past the lower channel portion of the channel member. As a result, the restraining spring no longer catches on the lower channel portion of the channel member. This done, the user may then freely move the blade carrier forward to the blade change position by simultaneously applying pressure to the operating button, and sliding the operating button, and thus the blade carrier, toward the front end of the knife.

These and other features and advantages of the present invention will be further made apparent with reference to the following detailed description, taken in conjunction with the accompanying drawings.

DETAILED DESCRIPTION OF THE PREFERRED EMBODIMENT(S)

The following detailed description is provided to enable any person skilled in the art to make and use the invention, and to set forth the best mode(s) contemplated by the inventor for carrying out the invention. This description is not to be taken in a limiting sense, but is made instead for the purpose of illustrating the general principles of the invention through discussion of specific examples.

Figures 1, 2:
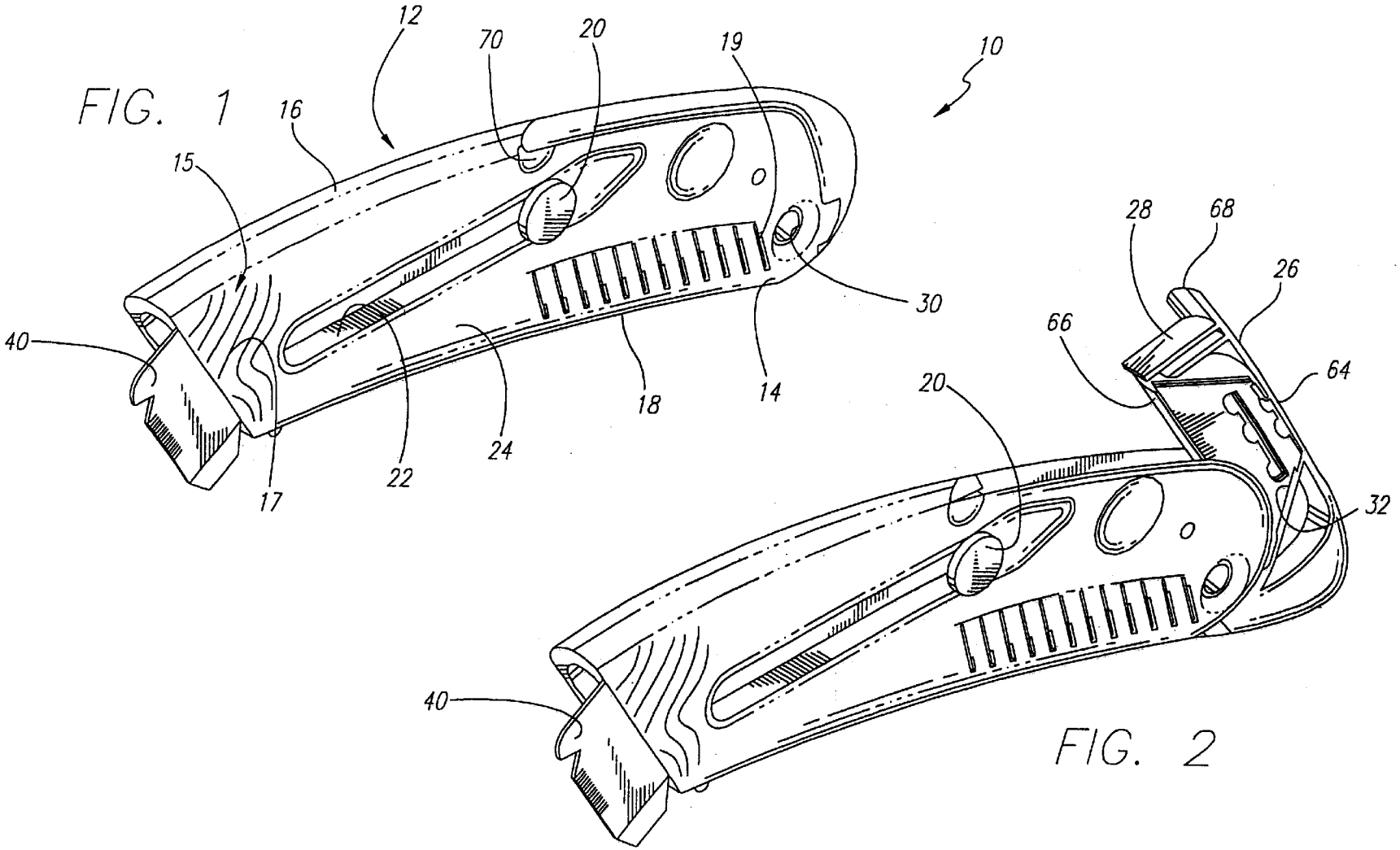
FIG. 1 is a right side perspective view of an improved utility knife illustrating principles of the invention, shown with the blade and blade carrier being fully retracted into the knife's handle.
FIG. 2 is a right side perspective view of the improved utility knife of FIG. 1, showing a spare blade storage compartment pivoted upwardly out of the knife's handle.

With reference to FIG. 1, an exemplary utility knife made for a right-handed user is shown. A left-handed knife is the same in all respects, save being configured as a mirror image of the right-handed knife. The utility knife 10 includes an ergonomically-shaped handle 12 having a front end 11 and a back end 13. The handle in the illustrated embodiment is formed of a polymeric resin by injection molding, and includes shallow grooves 19 on both right and left sides to provide better grip for a user of the knife. The handle also has a side surface portion 15 which is textured with ridges 17 emulating generally a pattern of a thumbprint to provide secure engagement of the user's thumb. Furthermore, the handle is overall of curved configuration to fit more comfortably and securely in the hand, and includes an upper convex surface 16, and a lower concave surface 18. The curved surfaces 16, 18 cooperate to provide a handle 12 that would naturally lay in the palm of an average user's hand, with the convex surface against the palm, and the fingers wrapped around the concave lower surface. Purchase is improved by the curved shape; particularly when drawing the knife toward the user.

The handle 12 can also be formed of other materials, such as metal, and composites such as filled polymer resins and other combinations of materials. The surface can be treated to provide texture or coated with another material, with a view to improving the frictional resistance to slipping in a user's hand, and/or improving comfort.

The utility knife 10 is shown in a safe storage condition with a cutting blade (34 in FIG. 3) being fully retracted into the handle 12. An operating button 20 extends outwardly through a slot 22 on the right side surface 24 of the handle. In the preferred embodiment, the operating button may be used to move the cutting blade to a plurality of operating positions, including a retracted position, a first cutting position, an intermediate cutting position, a last cutting position, and a blade changing position.

Figure 3:
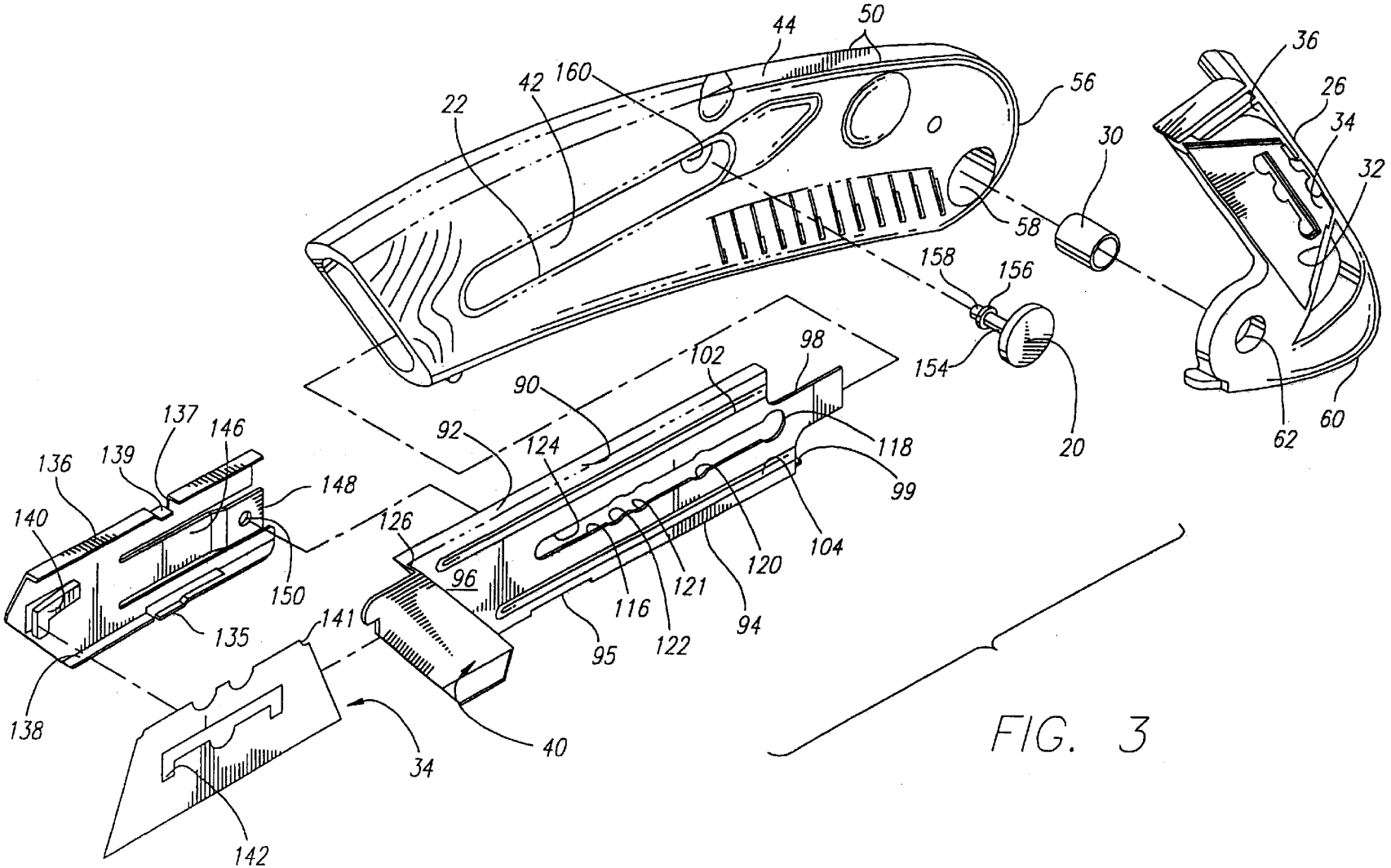
FIG. 3 is an exploded perspective view of the utility knife of FIGS. 1 and 2.

With reference also to FIGS. 2 and 3, the utility knife 10 includes a spare blade storage compartment 26 shown pivoted upwardly at its forward end 28 out of the handle portion 12 to an open position. The spare blade storage compartment is pivotally attached to the handle portion by a pivot pin 30. The spare blade storage compartment 26 has a blade pocket 32 for receiving a plurality of all-purpose utility blades 34. The blade pocket communicates with a slightly smaller window 36 that opens away from the viewer of FIG. 2 so that spare blades cannot escape in that direction. The window 36 is sufficiently large that a user's finger may be used to bring the blades forward for removal and use, the nearest blade being dispensed first.

The storage compartment 26 is accessed by lifting a tab 68 adjacent an indentation 70 when the storage compartment is folded into the handle 12. The compartment resists opening by virtue of a detent 66 and frictional resistance to sliding between the compartment 26 and the handle 12.

Considering now more particularly FIG. 3, the handle 12 has a longitudinal cavity 42, and a rear recess 44 which opens upwardly and rearwardly. The rear recess is cooperatively defined by a pair of spaced apart side walls 50 and is adapted to receive a spare blade holder compartment 26. The side walls 50 include arcuate ends 56 and a pair of aligned bores 58 on the side walls. The spare blade holder compartment has a cooperating bore 62 operable in conjunction with the aligned bores 58 to receive the pivot pin 30. Once the pivot pin is inserted through the bores 58,62, its end 31 may be swaged to permanently retain the pin 30 in the bores 58,62 and fixedly hold the spare blade holder compartment 26 in the rear recess 44.

The arcuate ends 56 of the side walls 50 are disposed somewhat downwardly. In other words, the arcuate ends 56 are disposed down and away from the upper convex surface 16 and toward the lower concave surface 18. The combination of an overall flattened oval cross sectional shape of the handle 12, the upper convex surface 16, the lower concave surface 18, and the relative lowered position of the arcuate ends 56 all cooperate to provide an overall ergonomic shape for the knife 10.

Figure 4:
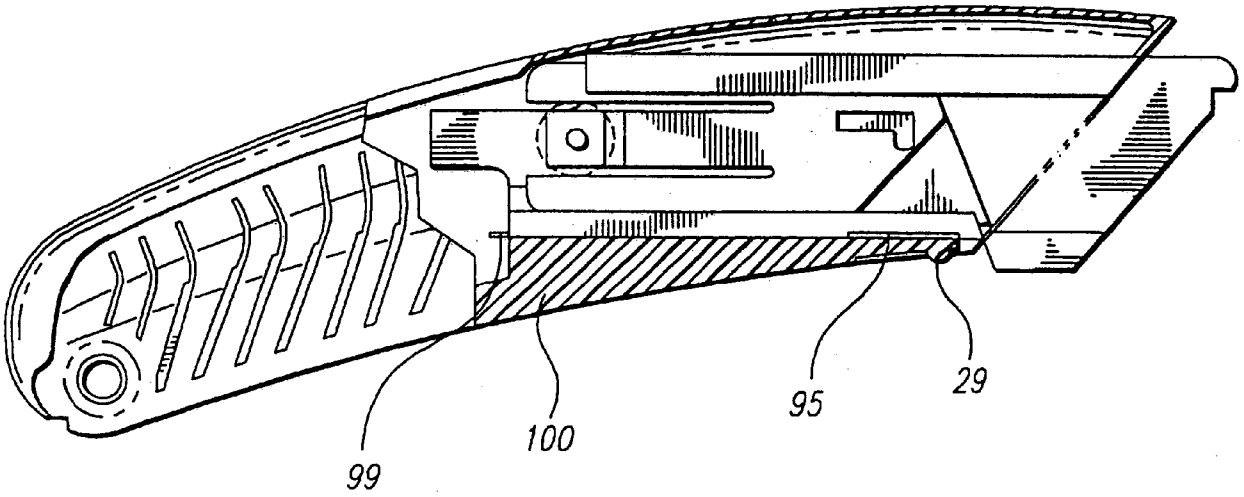
FIG. 4 is an elevational fragmentary left side view, partially in section, of the utility knife of FIG. 1.

With reference now to FIGS. 3 and 4, the longitudinal cavity 42 is adapted to fixedly receive an elongate metal channel member 90. The channel member 90 has an upper channel portion 92 and a lower channel portion 94 which are separated by a web portion 96. At its aft end 97, the lower channel portion 94 has a retainer tang 99. When the channel member 90 is inserted into the cavity 42 of the handle, the lower channel portion 94 generally lays on top of a raised platform 100 defined within the cavity 42, such that the retainer tang 99 extends beyond the platform 100. The retainer tang 99 can then be bent generally downward to form an L-shape angular hook (see FIG. 5) to permanently retain the channel member 90 inside the handle 12. To further assist in stabilizing the channel member in the cavity small bumps 91 are formed in the channel member adjacent its front end.

Figure 5:
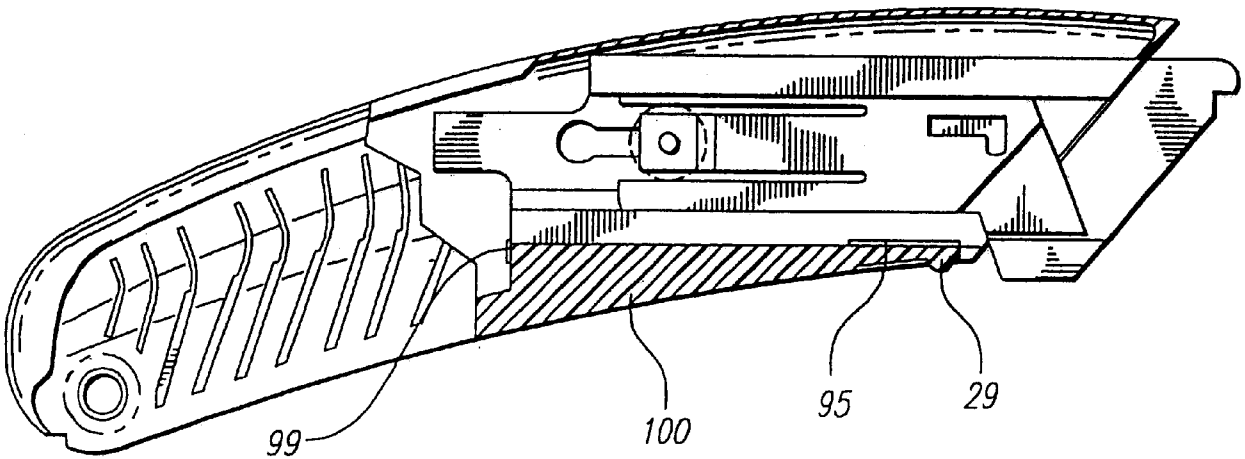
FIG. 5 is an elevational fragmentary left side view, partially in section, of the utility knife of FIG. 4, with the blade being advanced to a first cutting position.

As illustrated in FIGS. 3, 4 and 5, the upper channel portion 92 and lower channel portion 94 include a pair of side surfaces 106, 108, respectively. At its aft end 97, the channel member 90 includes a tang 98 extending from the web portion 96. When the channel member is inserted into the handle cavity 42, the tang 98 extends into the rear recess 44.

The channel member 90 also defines a longitudinal slot 116. The longitudinal slot has a slot enlargement 118 located at the slot's aft end, and a plurality of spaced-apart semi-circular slot enlargements 120, 121, 122 disposed sequentially at various intervals forwardly from the back end slot enlargement 118. The longitudinal slot 116 also has a forward slot portion 124 forward of the semi-circular slot enlargements. When the channel member 90 is inserted in the longitudinal cavity 42 of the handle 12, the slot 22 of the handle is generally aligned with the slot 116 of the channel member 90.

The channel member 90 includes a blade guard 40 which also serves as a cutting guide, and which extends forwardly of the handle 12 when the channel member 90 is inserted therein. To position the blade guide/guard 40, the channel member 90 includes an angulated portion 126. The angulated portion provides an offset from the blade 34 and acts as a stop cooperatively against the handle 12 to limit how far the channel member can be inserted into the longitudinal slot 42. In front of the angulated portion 126, the guard includes an outer plate-like portion 128. The outer plate-like portion is substantially larger than the angulated portion 126, and is generally perpendicular to the angulated portion 126. At its lower extent, the outer plate like portion 128 of the guard 40 includes an outwardly turned portion 130 which serves, in a manner analogous to a ski tip, to facilitate the sliding of the guard 40 over an outer surface of an object that the user is attempting to cut, the guard acting as a guide to position the blade for cutting. The outer plate-like portion 128 is disposed at an angle with respect to the rest of the channel member 90, and so deflects somewhat to the left in FIG. 3. This provides a non-parallel relationship between the outer plate-like portion and the blade 34 in cutting the blade and guard 40 converging. As the outer plate-like portion glides across the top surface of a box (not shown) the blade will be angled upward, away from the contents of the box.

The channel member 90 is configured to slidably receive a blade carrier 132. The blade carrier is generally channel-shaped and formed of metal, preferably a spring steel material. The blade carrier has a web portion 134, an upper laterally extending wall 136, and a lower laterally extending wall 138. The web portion, the upper laterally extending wall, and the lower laterally extending wall together define a blade receiving recess 133 to receive a blade 34. The web portion 134 includes a raised alignment tab 140 to guide the placement of, and assist in retention of, the cutting blade.

Furthermore, the blade carrier 132 includes a spring arm 146, which has an aperture 150 near its distal end 148. The aperture 150 is adapted to receive a rivet end 158 of an operating button 20. To properly position the blade 34, a user aligns a cut-out section 142 of the blade with the raised alignment tab 140. The blade is fore-and-aft symmetrical so that it can be reversed, and the cut-out section is likewise symmetrical. Once the blade is properly placed in the blade carrier 132, the raised alignment tab and the recess 133 hold the blade in place and prevent the blade from sliding vertically or horizontally. The blade carrier 132 also includes a notch 137 with a tang 139 to engage a corresponding notch 141 on the aft end of the blade 34 serving to further stabilize the blade. When the blade 34 is contained in the blade carrier and the blade carrier is received in the channel member 90, two longitudinal indentations 102, 104 formed in the channel member extend inward toward the blade and further stabilize it.

The operating button 20 is configured to facilitate positioning the blade carrier 132 in the channel member 90 and includes a shaft 154 with an enlarged collar 156, and the rivet end 158 previously mentioned extending beyond the enlarged collar. During manufacturing of the knife 10, with the cutting blade carrier 132 placed in the channel member 90 and the channel member inserted in the handle 12, the operating button 20 can be inserted inwardly through the slot 22 in the handle and slot enlargement 118 in the channel member, such that the rivet end 158 of the operating button 20 is extended through the aperture 150 of the blade carrier 132. An opening 160 in an opposite side of the handle aligns with the aft end slot enlargement 118 when the channel member is properly inserted in the handle, and the operating button's rivet end 158 when it is thus inserted into the blade carrier. A tool may be laterally inserted through the opening 160 to swage the rivet end 158 to fixedly attach the operating button to the spring arm 146, and thereby also capture the blade carrier 132 in the channel member 90. The blade carrier thereafter can slide within the channel member a distance commensurate with the length of the slot 116, but cannot slide out.

The enlarged collar 156 of the operating button 20 is appropriately sized for a snug fit in each of the slot enlargements 118, 120, 121, 122. When the enlarged collar is aligned with one of the slot enlargements, the spring arm 148 of the blade carrier 132, which applies a bias to the operating button 20 to push the button 20 outwardly, is allowed to do so and the enlarged collar 156 is received in the aligned slot enlargement 118, 120, 121 or 122. Once the enlarged collar 156 is received in the slot enlargement, the operating button 20 is immovable in a longitudinal direction along the slot 116. As a result, the blade carrier 132 is prevented from sliding longitudinally within the channel member 90. However, a user can apply generally lateral pressure to the operating button 20 to depress the enlarged collar 156 out of the slot enlargement 118, 120, 121, or 122 to again slide the blade carrier 132 longitudinally along the channel member 90.

Figure 6:
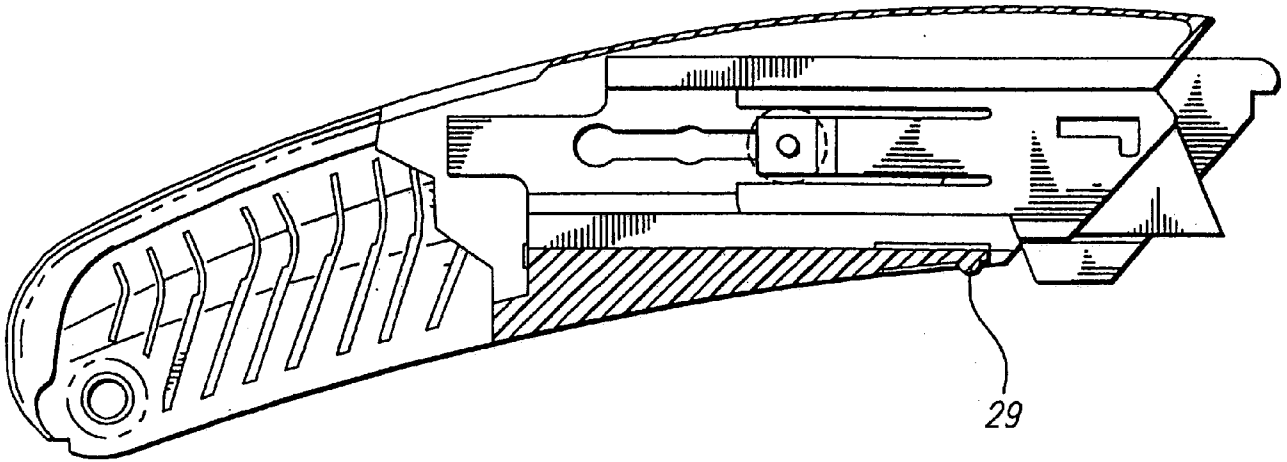
FIG. 6 is an elevational fragmentary left side view, partially in section, of the knife of FIG. 5, with the blade being advanced to an intermediate cutting position.
Figure 7:
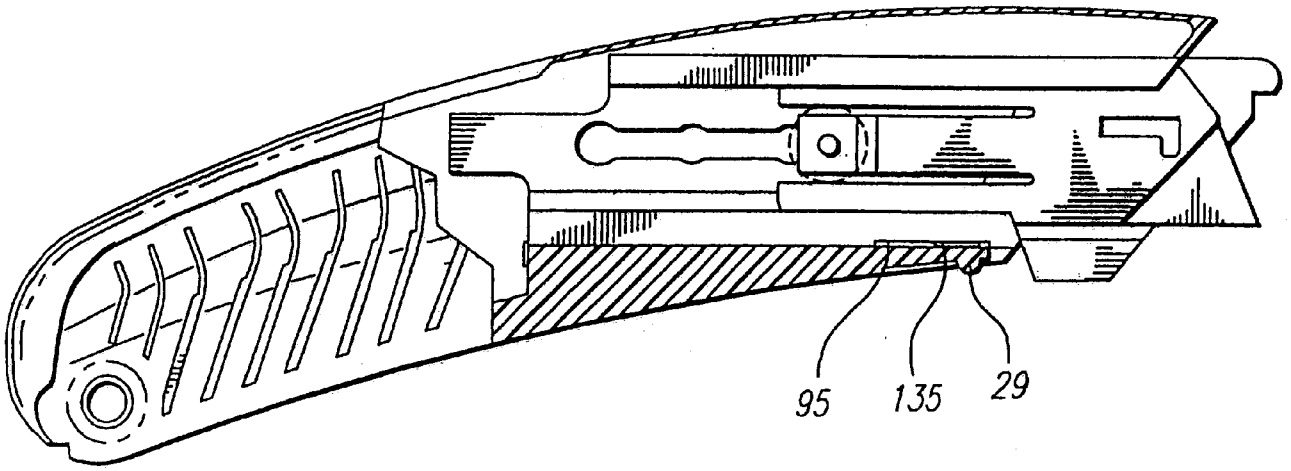
FIG. 7 is an elevational fragmentary left side view, partially in section, of the knife of FIG. 6, with the blade being advanced to a last or foremost cutting position.

Considering FIGS. 4–10, the different operating positions of the blade 34 of the utility knife 10 are illustrated. FIG. 4 shows the blade fully retracted into the knife's handle 12 and the operating button 20 placed in the aft slot enlargement 118 (shown in phantom). FIG. 5 shows the operating button placed in the first semicircular slot enlargement 120 (shown in phantom) and the blade extended to a first cutting position. FIG. 6 shows the utility knife with the operating button placed in the second semi-circular slot enlargement 121 (shown in phantom) and the blade 34 thereby extended to an intermediate cutting position. FIG. 7 shows the utility knife with the operating button placed in the most forward semi-circular slot enlargement 122 (shown in phantom) and the blade extended to a foremost cutting position.

Figure 8:
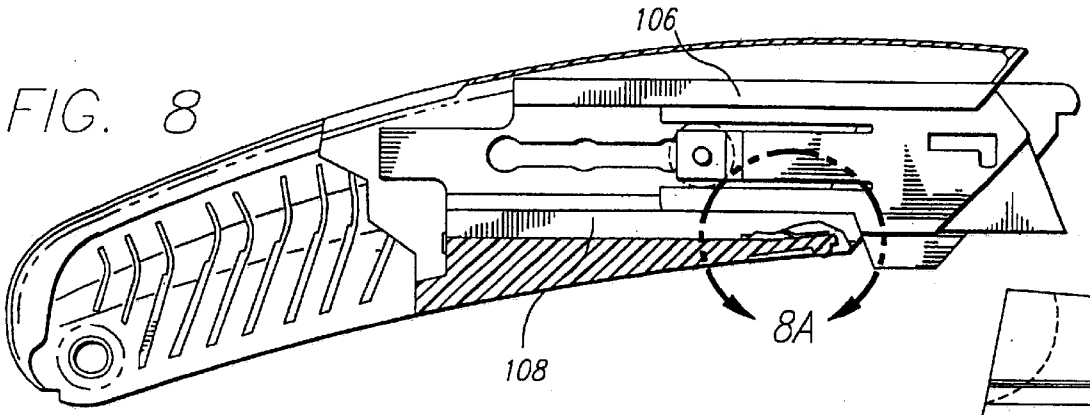
FIG. 8 is an elevational fragmentary left side view, partially in section, of the knife of FIG. 7, with the catch released to allow further motion of the blade carrier in a forward direction.

With reference to FIGS. 7 and 8, as noted above a user may apply generally lateral pressure to the operating button 20 to depress the enlarged collar (156 in FIG. 3) of the operating button 20 out of a slot enlargement 118, 120, 121 or 122 to move the blade carrier 132 longitudinally along the channel member 90. However, when the operating button is placed in the last or most foreword slot enlargement 122, and the blade 34 is extended to a forward cutting position, a catch 93 (shown in FIG. 8A) prevents the user from moving the blade carrier 132 and the blade 34 forward to a blade change position.

Figure 8A:
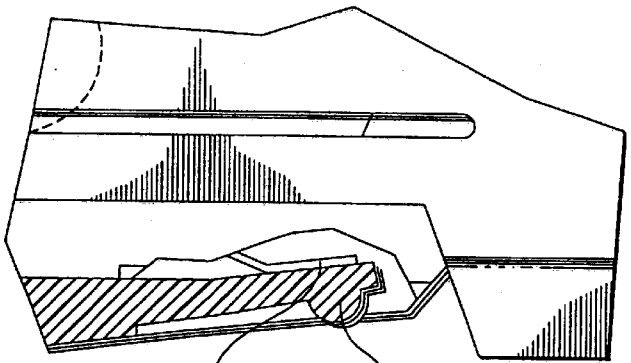
FIG. 8A is an enlarged elevational fragmentary left side view, partially in section, of a portion of the knife of FIG. 8, focusing on the safety lever mechanism.

As seen in FIGS. 8 and 8A, the catch is formed from the cooperation of a number of elements, including a restraining spring 135 integral with the blade carrier 132, the recess 95 formed in the channel member 90, and the safety lever 29 integral with the handle 12. In a presently preferred embodiment, the restraining spring 135 is formed unitary with the blade carrier on the lower laterally extending wall 138. As the blade carrier includes the restraining spring and the spring arm 146, it is preferably formed of a spring steel as mentioned. The cooperating recess 95 is formed on the lower channel portion 94 of the channel member and is adapted to receive the restraining spring. As the recess and the restraining spring are brought into alignment the restraining spring drops downward. The restraining spring is formed such that it has a downward bias. When the blade carrier 132 is fully retracted into the handle 12 or is extended to the first or intermediate cutting position, the restraining spring is retained within the lower channel portion 94 of the channel member 90. However, when the blade 34 is extended to the last cutting position, the restraining spring 135 aligns with the recess formed in the lower channel portion of the channel member, as shown in FIGS. 6 and 7 and drops down to contact or very nearly contact the safety lever 29.

In this last cutting position, the downward bias of the restraining spring 135 causes the spring to drop down into the recess 95 such that the spring contacts and catches on the lower channel portion 94, as depicted in FIG. 7. The contact between the restraining spring 135 and the lower channel portion 94 restricts the forward longitudinal movement of the blade carrier 132. Accordingly, a user cannot move the blade carrier forward beyond this position even if the user applies lateral pressure to the operating button 20 to depress the enlarged collar 156 out of the slot enlargement 122. However, the user can still move the blade carrier backward to the intermediate cutting position, the first cutting position, or the retracted position by applying lateral pressure to the operating button and simultaneously sliding the blade carrier backward. This is because the restraining spring does not prevent backward movement, but simply deforms to bend up and out of the recess 95, due to its shape.

Figure 9:
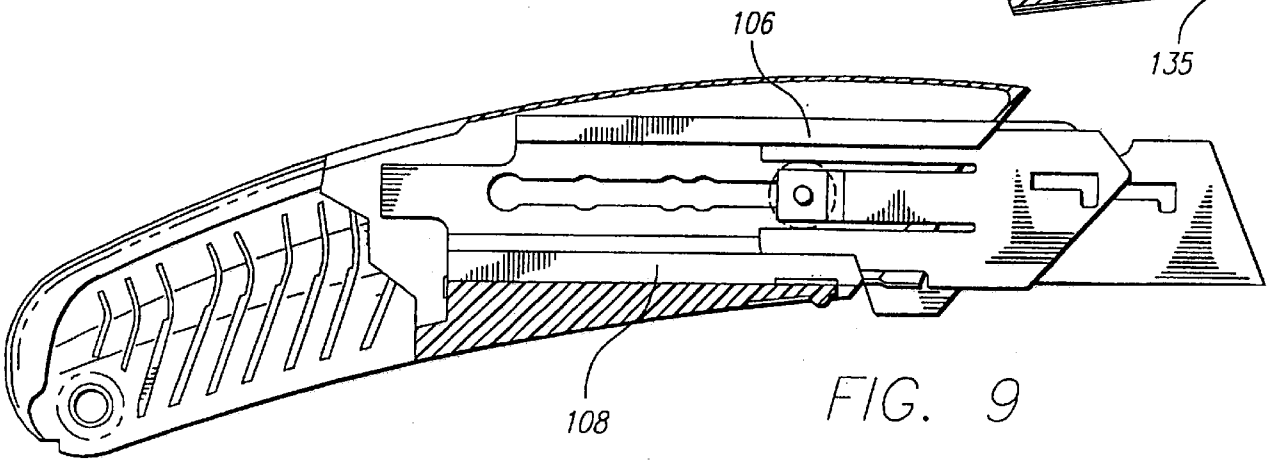
FIG. 9 is an elevational fragmentary left side view of the knife of FIGS. 7 and 8, with the blade advanced to a blade change position.

To move the blade carrier 132 from the last cutting position forward to a blade change position, as depicted in FIG. 9, a user needs to simultaneously do the following: a) apply vertical pressure to the safety lever 29 located on the lower concave surface 18 of the handle 12, and as shown in FIGS. 8 and 8A; b) apply lateral pressure to the operating button 20; and c) slide the operating button 20 along the forward slot portion 124 forward of the semi-circular slot enlargements 120, 121, 122.

When upward pressure is applied to the safety lever 29 to cause the lever to move inward into the handle 12, the safety lever contacts the restraining spring 135 and causes the spring 135 to also move inward. As a result, the restraining spring no longer catches on the lower channel portion 94 of the channel member 90, but is lifted over it by the safety lever when the restraining spring moves foreword. The user can thus freely move the blade carrier 132 forward to the blade change position.

Figure 10:
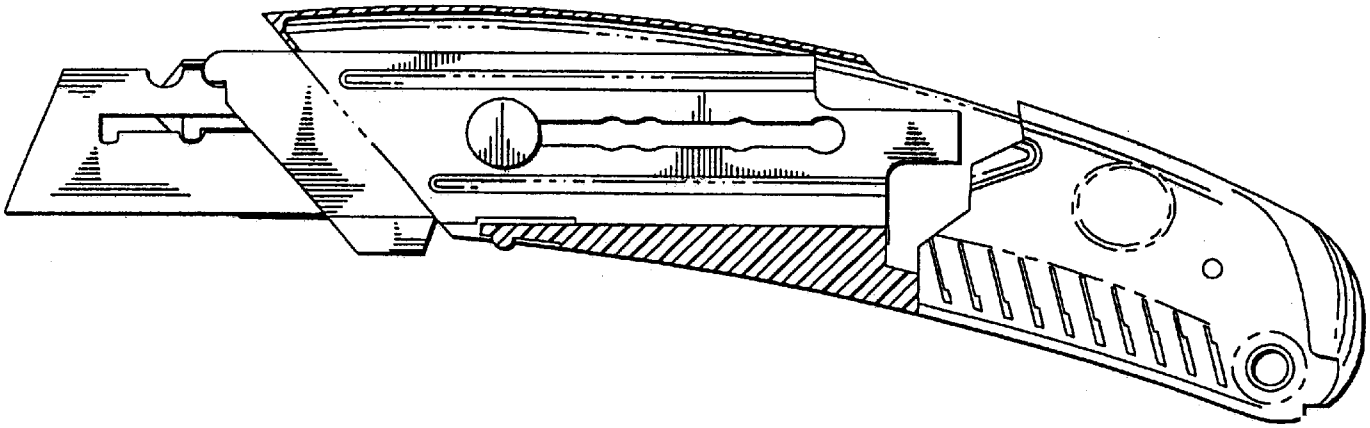
FIG. 10 is an elevational fragmentary right side view, partially in section, of the knife of FIG. 9, with the blade being advanced to a blade change position.
Figure 11:
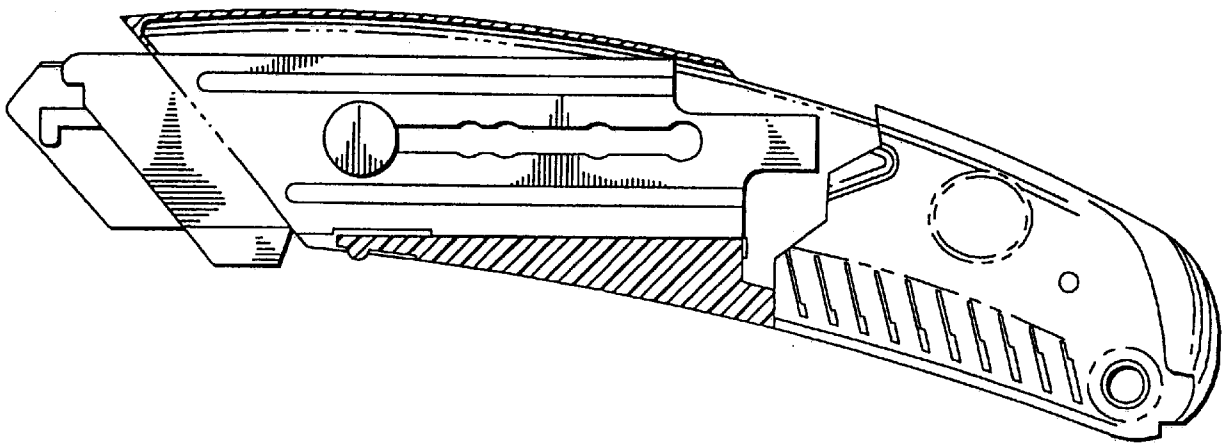
FIG. 11 is a view similar to FIG. 10 but with a blade removed.

With reference to FIGS. 9 and 10, when the operating button 20 is moved to the front end of slot portion 124 forward of the semi-circular slot enlargements 120, 121,122, the blade carrier 132 is advanced foreword and partially out of the channel member 90 to the blade changing position. In the blade changing position, the blade is presented for removal from the blade carrier 132. The user can remove the blade from the blade carrier 132, and reverse it, or place a new blade into the carrier 132, as is perhaps better appreciated with reference to FIG. 3. To properly place the new blade into the blade carrier 132, the user simply aligns the cut-out section 142 of the blade 34 with the raised alignment tab 140 on the blade carrier 132.

With reference again to FIGS. 9 and 10, the blade carrier 132 can be retracted back into the channel member 90 without depressing the safety lever 29, or pushing the operating button 20 inwardly. The operating button will snap into the foreword-most semi-circular slot enlargement 122, however, if it is not held inward. The desired blade position can then be selected in accordance with the operation of the knife 10 as before described.

As will be appreciated, the knife 10 described herein provides advantages in safety as well as ergonomics, and ease of use. The knife is more secure from the standpoint of unintended extension of the blade due to the provision of the catch 93 and safety lever 29 arrangement in combination with the interaction of the operating button 20 with the slot 116 semi-circular enlargements 118, 120, 121, 122. Moreover, the construction allows rapid assembly from a small number of parts. When assembled the design comprises a rugged and effective knife which gives improved purchase and reduced hand strain and discomfort for the user.

Although the present invention has been described in terms of presently preferred embodiments illustrated and discussed herein, the applicability of numerous modifications and/or additions within the spirit and scope of the invention will be readily apparent to one skilled in the art. Accordingly, the present invention is not limited to the specific embodiments illustrated and described herein.

I claim:

1. A utility knife, comprising:

a blade;

a handle having a longitudinal cavity;

a channel member fixedly received in the longitudinal cavity and including a lower channel portion having a recess;

a blade carrier slidably received in the channel member to carry the blade, the blade carrier having a lower laterally extending wall;

an operating button connected to the blade carrier to facilitate movement of the blade carrier to a plurality of operating positions; and a catch configured to prevent the blade carrier from being fully extended, the catch including a restraining spring integral with the lower laterally extending wall of the blade carrier, the restraining spring having a downward bias causing the restraining spring to drop down into the recess formed in the lower channel portion and contact the lower channel portion when the restraining spring is aligned therewith, thereby restricting the forward longitudinal movement of the blade carrier.

2. The utility knife of claim 1, wherein the catch further comprises a safety lever integral with the handle and aligned with the recess on the lower channel portion, such that pressure can be applied to move the safety lever inward to contact the restraining spring and move the restraining spring inward, thereby removing the restriction on the forward longitudinal movement of the blade carrier.

3. The utility knife of claim 1, wherein the blade carrier includes a blade receiving recess to receive the blade, and a raised alignment tab configured for alignment with a cut-out section of the blade to guide the placement of the blade into the blade receiving recess.

4. The utility knife of claim 1, wherein:

the handle further comprises a raised platform defined within the longitudinal cavity;

the channel member further comprises a retainer tang extending from the lower channel portion; and the channel member is received in the longitudinal cavity such that (1) the lower channel portion lays on top of the raised platform and (2) the retainer tang extends beyond an end of the raised platform and can be bent generally downward to form an angular hook to permanently retain the channel member inside the longitudinal cavity.

5. A utility knife, comprising:

a blade;

a handle having a longitudinal cavity;

a channel member fixedly received in the cavity;

a blade carrier slidably received in the channel member, the blade carrier having a blade receiving recess configured to receive the blade, and a raised alignment tab configured to align with a cut-out section of the blade to guide the placement of the blade into the blade receiving recess; and an operating button connected to the blade carrier to facilitate movement of the blade carrier to a plurality of operating positions, wherein:

the handle further comprises a raised platform defined within the cavity;

the channel member further comprises a lower channel portion and a retainer tang extending from the lower channel portion; and the channel member is fixedly received in the longitudinal cavity such that (1) the lower channel portion lays on top of the platform and (2) the retainer tang extends beyond an end of the platform and is bent generally downward to form an angular hook to permanently retain the channel member inside the cavity.

6. A utility knife, comprising:

a blade;

a handle having a longitudinal cavity;

a channel member fixedly received in the cavity;

a blade carrier slidably received in the channel member, the blade carrier having a blade receiving recess configured to receive the blade, and a raised alignment tab configured to align with a cut-out section of the blade to guide the placement of the blade into the blade receiving recess; and an operating button connected to the blade carrier to facilitate movement of the blade carrier to a plurality of operating positions, wherein the utility knife further comprises a catch to prevent the blade carrier from being fully extended.

7. The utility knife of claim 6, wherein:

the channel member further comprises a lower channel portion having a recess; and the catch further comprises a restraining spring formed on a lower laterally extending wall of the blade carrier, the restraining spring has a downward bias causing it to drop down into the recess on the lower channel portion and contact the lower channel portion when the restraining spring is aligned with the recess, thereby restricting the forward longitudinal movement of the blade carrier.

8. The utility knife of claim 7, wherein the catch further comprises a safety lever formed on a lower surface of the handle and is aligned with the recess on the lower channel portion, such that pressure can be applied to move the safety lever inward to contact the restraining spring and move the restraining spring inward, thereby removing the restriction on the forward longitudinal movement of the blade carrier.

9. The utility knife of claim 6, wherein the channel member has means for providing a plurality of operating positions for the blade carrier which include a retracted position, a first cutting position, an intermediate cutting position, a last cutting position, and a blade change position.

10. A utility knife, comprising:

a blade;

a handle having a longitudinal cavity and a raised platform defined within the cavity;

a channel member having a lower channel portion and a retainer tang extending from the lower channel portion, the channel member being fixedly received in the longitudinal cavity such that (1) the lower channel portion lays on top of the platform and (2) the retainer tang extends beyond an end of the platform and is bent generally downward to form an angular hook to permanently retain the channel member inside the cavity;

a blade carrier slidably received in the channel member, the blade carrier cooperating with the channel member to receive and hold the blade; and an operating button connected to the blade carrier to facilitate movement of the blade carrier to a plurality of operating positions.

11. The utility knife of claim 10, wherein the utility knife further comprises:

a catch to prevent the blade carrier from being fully extended forwardly beyond a selected position; and the catch comprises a restraining spring formed on a lower laterally extending wall of the blade carrier, a recess formed on the lower channel portion of the channel member, and a safety lever formed on a lower concave surface of the handle.

12. The utility knife of claim 11, wherein the restraining spring has a downward bias causing the restraining spring to drop down into the recess and contact the lower channel portion when the restraining spring is aligned with the recess, thereby restricting the forward longitudinal movement of the blade carrier.

13. The utility knife of claim 11, wherein the safety lever is aligned with the recess on the lower channel portion of the channel member, such that pressure can be applied to move the safety lever inward to contact the restraining spring and move the restraining spring inward thereby removing the restriction on the forward longitudinal movement of the blade carrier beyond the selected portion.

14. The utility knife of claim 10, wherein:

the blade further comprises a C-shape cut-out section; and the blade carrier further comprises a blade receiving recess to receive the blade and a raised alignment tab to align with the C-shape cut-out section of the blade to guide the placement of the blade into the blade receiving recess.

15. A utility knife having a retractable blade, comprising:

a handle having a longitudinal cavity;

a channel member having a lower channel portion and a retainer tang extending from the lower channel portion, the lower channel portion including a recess;

a blade carrier slidably received in the channel member, the blade carrier having a blade receiving recess to receive the blade and a lower laterally extending wall;

an operating button connected to the blade carrier to facilitate movement of the blade carrier to a plurality of operating positions; and a catch including a restraining spring integral with the lower laterally extending wall of the blade carrier, the restraining spring having a downward bias causing the restraining spring to drop down into the recess in the lower channel portion and contact the lower channel portion when the blade carrier is at a position where the restraining spring is aligned with the recess, thereby restricting the forward longitudinal movement of the blade carrier to prevent movement beyond that position.

16. The utility knife of claim 15, wherein the catch further includes a safety lever formed on a lower surface of the handle and aligned with the recess, such that pressure can be applied to move the safety lever inward to contact the restraining spring and move the restraining spring inward, thereby removing restriction on the forward longitudinal movement of the blade carrier.

17. A method of providing a utility knife, the method including the steps of:

providing a handle having a longitudinal cavity and a raised platform defined within the cavity;

inserting into the cavity a channel member having a lower channel portion and a retainer tang extending from the lower channel portion, the channel member being inserted into the cavity such that the lower channel portion lays on top of the platform and the retainer tang extends beyond an end of the platform;

bending the retainer tang generally downward to form an angular hook to permanently retain the channel member within the handle;

providing a blade carrier having a blade receiving recess and a raised alignment tab, and inserting into the channel member; and providing a safety mechanism to prevent the blade carrier from being fully extended.

18. The method of claim 17, further comprising the steps of:

providing a blade having a C-shape cut-out portion; and positioning the blade such that the C-shape cut-out section of the blade is aligned with the raised alignment tab.

19. The method of claim 17, wherein the method further comprises a step of connecting an operating button to the blade carrier to facilitate movement of the blade carrier to a plurality of operating positions.

* * * * *